US007878297B2

(12) United States Patent
Baker et al.

(10) Patent No.: US 7,878,297 B2
(45) Date of Patent: Feb. 1, 2011

(54) ACOUSTIC TRANSDUCER MADE OF PURE BERYLLIUM WITH DIRECTED RADIATION, WITH A CONCAVE-SHAPED DIAPHRAGM, FOR AUDIO APPLICATIONS, IN PARTICULAR FOR ACOUSTIC ENCLOSURES

(75) Inventors: Dominc Baker, La Versanne (FR); Jacques Mahul, Bonson (FR)

(73) Assignee: Focal-JMLAB (S.A.), La Talaudiere (FR)

( * ) Notice: Subject to any disclaimer, the term of this patent is extended or adjusted under 35 U.S.C. 154(b) by 0 days.

(21) Appl. No.: 12/365,537

(22) Filed: Feb. 4, 2009

(65) Prior Publication Data

US 2009/0200101 A1 Aug. 13, 2009

Related U.S. Application Data

(63) Continuation of application No. 10/553,185, filed as application No. PCT/FR2004/000704 on Mar. 22, 2004, now abandoned.

(30) Foreign Application Priority Data

Apr. 16, 2003 (FR) ..... 03 04733

(51) Int. Cl.
*H04R 7/00* (2006.01)

(52) U.S. Cl. ..... 181/168; 181/167; 29/594; 29/609.1

(58) Field of Classification Search ..... 29/594, 29/609.1; 181/167, 168
See application file for complete search history.

(56) References Cited

U.S. PATENT DOCUMENTS

| | | | | |
|---|---|---|---|---|
| 1,961,149 | A * | 6/1934 | Hoffmann et al. | 181/165 |
| 2,974,204 | A | 3/1961 | Supitilov | |
| 4,029,171 | A * | 6/1977 | Manger | 181/167 |
| 4,112,168 | A | 9/1978 | Schafft | |
| 4,122,314 | A | 10/1978 | Matsuda et al. | |
| 4,129,195 | A | 12/1978 | Ishii et al. | |
| 4,135,601 | A * | 1/1979 | Tsukagoshi et al. | 181/167 |
| 4,190,746 | A * | 2/1980 | Harwood et al. | 381/427 |

(Continued)

FOREIGN PATENT DOCUMENTS

GB 2 245 591 A 1/1992

(Continued)

OTHER PUBLICATIONS

Machine Translation of Tonegawa from Patent abstracts of Japan.*

*Primary Examiner*—Elvin G Enad
*Assistant Examiner*—Forrest M Phillips
(74) *Attorney, Agent, or Firm*—Rothwell, Figg, Ernst & Manbeck, P.C.

(57) ABSTRACT

A loudspeaker for acoustic enclosure, in particular a tweeter or a medium-frequency loudspeaker, which consists of a spherical diaphragm with direct radiation, with a front side that is concave in relation to the spool, and onto which is attached at a certain level, for example at mid-height or approximately at mid-height, the moving spool so as to achieve an optimal mechanical coupling capable of reproducing frequencies lower than 1 kHz with a high efficiency. Material such as pure beryllium or a Be/Al alloy or similar alloys is used to make the diaphragm.

Loudspeakers of the tweeter or medium type, especially for very high-fidelity acoustic enclosures.

33 Claims, 3 Drawing Sheets

U.S. PATENT DOCUMENTS

| | | | | |
|---|---|---|---|---|
| 4,709,392 | A * | 11/1987 | Kato et al. | 381/430 |
| 4,847,981 | A | 7/1989 | Suzuki et al. | |
| 5,062,140 | A * | 10/1991 | Inanaga et al. | 381/399 |
| 5,135,582 | A * | 8/1992 | Mochizuki et al. | 148/665 |
| 6,039,145 | A | 3/2000 | Ogura et al. | |
| 6,243,472 | B1 | 6/2001 | Bilan et al. | |
| 6,394,224 | B1 * | 5/2002 | Liu | 181/171 |
| 6,694,039 | B1 | 2/2004 | Wu | |
| 7,274,796 | B2 * | 9/2007 | Chan | 381/404 |
| 7,290,639 | B2 | 11/2007 | Sato et al. | |
| 2001/0050194 | A1 * | 12/2001 | Ishihara et al. | 181/167 |
| 2003/0053645 | A1 | 3/2003 | Kobayashi | |
| 2003/0075382 | A1 * | 4/2003 | Fontaine | 181/173 |
| 2005/0134374 | A1 * | 6/2005 | Hench et al. | 330/86 |
| 2005/0257998 | A1 * | 11/2005 | Sato et al. | 181/167 |
| 2005/0257999 | A1 * | 11/2005 | Tomiyama et al. | 181/168 |
| 2006/0113144 | A1 * | 6/2006 | Baker et al. | 181/168 |
| 2006/0262954 | A1 | 11/2006 | Lee et al. | |
| 2009/0116682 | A1 * | 5/2009 | Suzuki et al. | 381/412 |

FOREIGN PATENT DOCUMENTS

| | | | |
|---|---|---|---|
| JP | 04 287498 | A | 10/1992 |
| JP | 2002-369284 | * | 12/2002 |

* cited by examiner

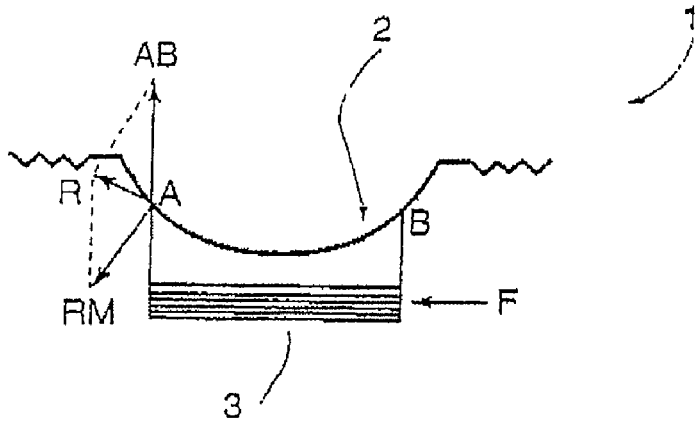
FIG. 1A
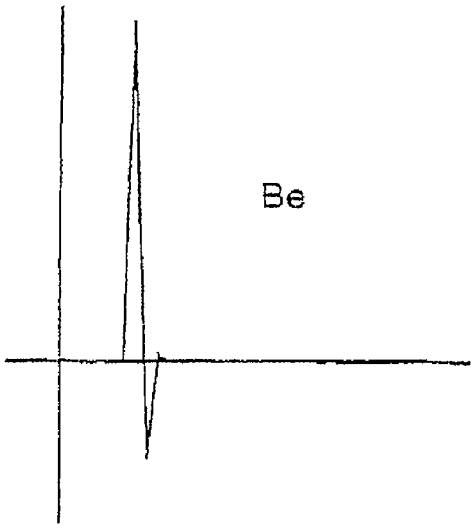
FIG. 2A
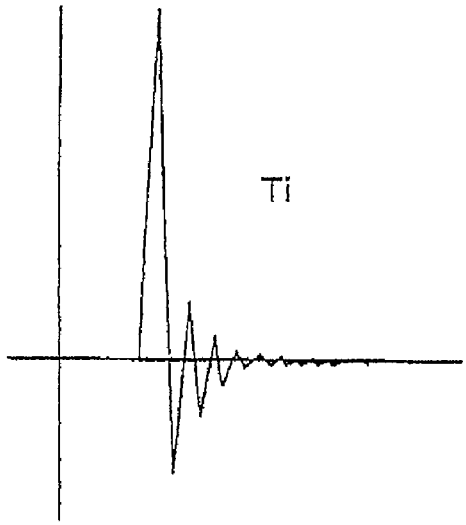
FIG. 2B
FIG. 2

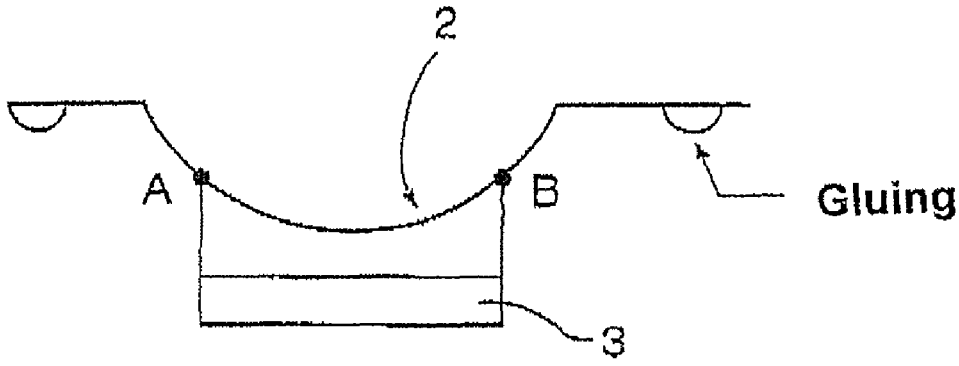
FIG. 1B "monobloc"

ACOUSTIC TRANSDUCER MADE OF PURE BERYLLIUM WITH DIRECTED RADIATION, WITH A CONCAVE-SHAPED DIAPHRAGM, FOR AUDIO APPLICATIONS, IN PARTICULAR FOR ACOUSTIC ENCLOSURES

FIELD OF THE INVENTION

This invention relates to the technical field of acoustic enclosures, in particular their "tweeter" component. More specifically, the invention relates to a sound reproducer with direct radiation that uses a very high performance emitter diaphragm constituting an emitter point source with a very wide passband in the audio and ultrasonic frequency range.

More specifically, the invention relates to loudspeakers for acoustic enclosures, in particular of the tweeter type, i.e., loudspeakers for reproduction of high pitch frequencies or even loudspeakers for medium-frequencies, and especially for very high-fidelity acoustic enclosures.

DESCRIPTION OF THE PRIOR ART

The diaphragm of a transducer ensures the mechanical coupling between a moving spool, placed in an air gap and passed through by a modulated current, and the air molecules, so as to ensure a reproduction of sounds. Three criteria govern the properties of a tweeter diaphragm: its weight, its rigidity, and its damping.

The diaphragm is usually made of a material that offers a reasonable compromise between the three above-specified criteria. The result: for a tweeter, the intrinsic rigidity of the material limits the high-frequency response.

The improvements contributed by the quality of digital sources and of amplifications (both in musical creation and in reproduction), with ever wider frequency bands from 20 Hz to 40 kHz, impose new challenges for transducers, namely: a higher rigidity for tweeter diaphragms in order to widen the frequency response; ever smaller masses so as to achieve acceleration factors adapted to the reproduction of transients produced by such frequency responses; controlled damping so as to eliminate the sound "colorations" inherent to the diaphragm material, which colorations are related to excess oscillations in pulsed mode.

Given the new digital audio formats, including for example 24 bits/96 kHz, Dolby™ Digital, SACT™, DVD™ Audio, it is strategic to improve the electrodynamic transducers so that the jump in quality brought about by these formats is ultimately detectable upon reproduction by the acoustic enclosure.

It is accepted that the tweeter diaphragms made of conventional materials cannot be further improved. The affordable metals, such as aluminum and titanium, that offer decent weight/rigidity ratios, do not allow for exceeding the 25 kHz frequency.

A number of materials that, in theory, could help a person skilled in the art utilize materials other than the above types are known in the prior art.

Beryllium (Be) might be included among such materials, but any person skilled in the art is aware of its inherent disadvantages:

for an identical mass, beryllium is almost 7 times more rigid than titanium and aluminum, which would in theory be an advantage for the manufacture of a tweeter diaphragm; however, it also represents a disadvantage for these very diaphragms, because its rigidity obviously inhibits its from being formed into a thin sheet;

it is extremely expensive;

no known metallurgic process, usable on an industrial scale, for this metal; as of this date, pieces in pure Be can be formed in a furnace over periods of about 12 hours, which would not be manageable on an industrial scale, even if the other disadvantages, including the prohibitive cost and scarcity of suppliers, were to be overcome;

due to its toxicity, beryllium requires a tightly-controlled manufacturing process.

STATEMENT OF TECHNICAL PROBLEM

In the field of loudspeakers for acoustic enclosures, particularly high or very high end loudspeakers, it is essential to arrive at a much better compromise solution than the current ones as regards the three diaphragm characteristics of weight or mass, rigidity, and damping.

As noted above, Be was a potential candidate. However, as of this date it is unusable unless accompanied by technologies that would reduce the cost of Be and enable its forming into thin sheets despite its well-known high rigidity, and unless the very technology for tweeters itself is improved.

SUMMARY OF THE INVENTION

The invention calls for a loudspeaker for acoustic enclosures, in particular a tweeter or a medium-frequency loudspeaker, with an original structure, that comprises a spherical diaphragm with direct radiation, with a front side that is concave in relation to the spool and onto which, preferably, there is attached at a certain level, for example at mid-height or approximately at mid-height, the moving spool in order to achieve an optimal mechanical coupling capable of reproducing frequencies lower than 1 kHz with a high efficiency.

By "attached at a certain level, for example at mid-height or approximately at mid-height," the expert will understand that the spool is attached at an intermediate level, of the type exemplified on FIG. 1, that any person skilled in the art will know how to adapt and optimize. The expert knows that a tweeter has a diameter of less than 50-70 mm, whereas a medium frequency loudspeaker generally has a diameter of 100 to 200 mm and a thickness of 0.1 to 0.4 mm.

The tweeter's low resonance frequency is adjustable as needed, optionally using a mounted suspension with high compliance. For the high-frequency response limit, the diaphragm mass should be reduced and its rigidity increased.

With a diaphragm in pure Be, manufactured as indicated below, the high-frequency response can be extended to over 40 KHz.

Ultimately, the combination of the concave dome technology, preferably with a mounted suspension, with the own characteristics of the pure beryllium diaphragm, makes it possible to design an emitter point source with direct radiation and low directivity, having a passband of over 5 octaves from 1 kHz to 40 kHz with a high efficiency of over 92 dB/1 W/1 m.

Moreover, the performance of beryllium with intrinsic damping offers an excellent pulsed response without any parasitic excess oscillation or coloration (ringing).

The invention also relates to and uses a process for the forming of thin sheets of certain metals or alloys, in particular beryllium. More specifically, but not limited thereto, the sheets thus formed are usable in domes of tweeters and of medium-frequency loudspeakers for acoustic enclosures.

Beryllium is particularly preferred; however, according to the invention, Be alloys can also be considered, in particular Be/Al alloys, in particular those made of 20-80% Be by weight/80-20% Al by weight, preferably 40-60% Be/60-40% Al, with at any rate at least 5% Be by weight. Pure Be shall be reserved for very high end brands, and beryllium/aluminum alloys for midrange brands.

For low-end brands, aluminum or aluminum alloys (in particular the Al/Be alloys described above for mid-range brands) can also be used.

Optionally, magnesium, and its alloys with aluminum, may also be used. Interestingly, but not limited thereto, the Al 5056 alloy may be used. This is an aluminum alloy, known to the expert, which contain approximately 5% magnesium.

This forming process is the subject matter of a British patent application, filed on the same date as this application under the name of Roy Rodriguez. It also applies to the other industries likely to be interested in the properties of beryllium, or other metals, but lacking the technical facilities for its molding (such as aerospace, aeronautic, nuclear, and/or electronic industries).

BRIEF DESCRIPTION OF THE DRAWINGS

The accompanying drawings, which are incorporated herein and form part of the specification, illustrate various embodiments of the present invention. In the drawings, like reference numbers indicate identical or functionally similar elements.

FIG. 1 (FIGS. 1A and 1B) shows cross sections of a tweeter according to an embodiment of the invention.

FIG. 2 (FIGS. 2A and 2B) shows exemplary pulsed response curves for domes of various materials according to an embodiment of the invention.

DETAILED DESCRIPTION OF THE INVENTION

Figure 3:
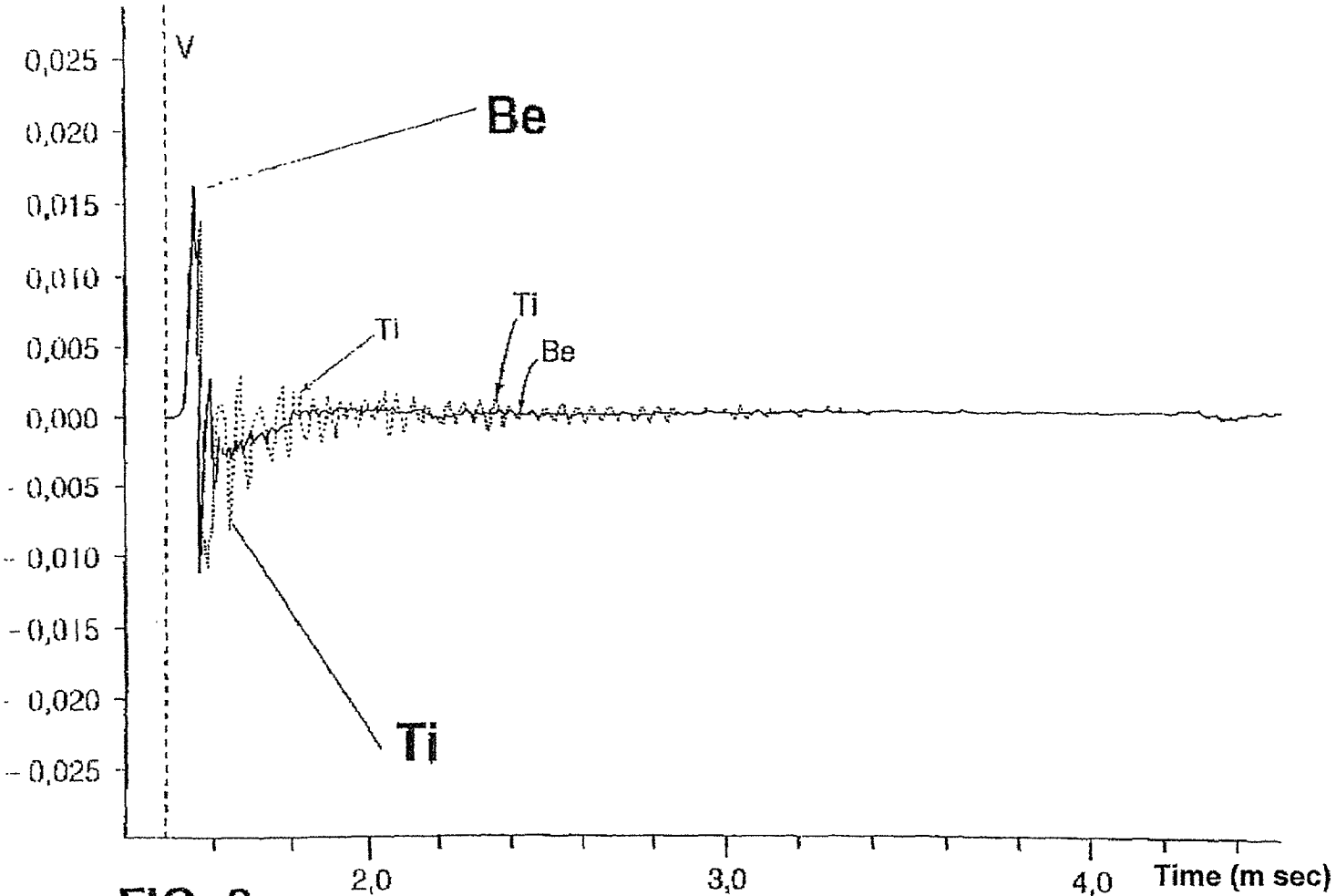
FIG. 3 shows the superimposed pulsed response curves of a titanium dome and a beryllium dome for a tweeter dome with a 25 mm diameter.

The invention calls for, according to a non-limitative but preferred embodiment (FIG. 1) a tweeter 1 with an original structure, comprising a spherical diaphragm 2 with direct radiation and a shape that is concave relative to spool 3.

Spherical diaphragms that were convex-shaped relative to the spool, that is to say, shaped as a "dome" above the spool are found in the prior art. In the present invention, however, the diaphragm forms a cup above the spool.

The low resonance frequency of the tweeter is adjustable as needed, optionally by use of a mounted suspension with high compliance, that is to say, a highly flexible material such as foam or soft joints made of rubber, or gluing that remains "soft" over time.

A most preferred diaphragm according to the invention is made of pure Be.

According to the best embodiment, the diaphragm made of pure Be has a thickness of 25 to 500 microns, preferably of less than 30 microns for a typical tweeter dome 25 mm in diameter and 3 to 6 mm deep and a spool 15 to 20 mm in diameter.

For a 100 mm medium-frequency loudspeaker, the dome thickness could be up to 100 microns.

The dome can have a hemispheric shape, or a complex-profile shape, or be oval, bulbous, or with canted sides.

According to a specific embodiment, FIG. 1A, the diaphragm 2 used is made of pure beryllium and 25 microns thick; its semi-spherical profile is concave relative to spool 3, and is optimized in order to push back as high as possible its own resonance frequency.

According to yet another specific embodiment, the moving spool is attached between the dome top and the periphery (Plane AB) of this semi-spherical diaphragm in order to achieve an ideal mechanical coupling.

The fine position of this plane is adjusted during the study, based on the mass/spool diameter dome rigidity ratios. It should be emphasized that usually, the spool is attached at the periphery of the dome, resulting in a mechanical coupling that is very much inferior to the solution herein (the expert may refer to a well-known conventional tweeter design).

It can be seen that on such a tweeter, the action F of the spool is fully transmitted to the dome in Plane AB.

According to a specific and preferred embodiment, as represented in FIG. 1A, a mounted suspension with appropriate compliance can be added so as to ensure the linking of the diaphragm to the support with a sufficiently low resonance frequency, typically 1 kHz.

According to the invention, it is also possible to manufacture monobloc domes such as represented in FIG. 1B.

The advantage of such a tweeter is that it makes it possible to reproduce a frequency range of over 5 octaves without resorting to a technology known as "super tweeter" that creates problems by introducing a time shift owing to the multiplying of emitter sources at frequencies with a wavelength of approximately 1 cm, thus annihilating the notion of point source which is essential in the recreating of 3D sound space.

Moreover, the need for a filtration in such a configuration results in phase distortions and in signal definition losses.

As represented on FIG. 2, an excellent pulsed response is achieved with beryllium, that is to say, a very clean response with a very well controlled damping (FIG. 2A). By contrast with titanium (FIG. 2B), an oscillatory sound coloration (ringing) is registered which, even if not directly perceived by the human ear, is harmful to the high fidelity of sound restitution and to listening comfort.

We have shown on FIG. 3 the superimposed pulsed response curves of a titanium dome and a beryllium dome for a tweeter dome with a 25 mm diameter.

According to its general concept, the invention uses for the manufacturing of the beryllium diaphragm a sheet metal forming process, described in detail in the British patent application filed on the same date as this application under the name of Roy Rodriguez, characterized in that said metal sheet is deformed using gas pressure applied at room or near-room temperature on one of its sides; next, using said pressure effect, the other side of said deformed sheet is applied onto a mold that reproduces the 3D geometry of the piece to be produced; finally, said mold is brought to a high temperature during the time necessary for the forming of said metal sheet without any physicochemical degradation.

Thus, the invention also uses a tool (also described in said British application) for the forming of thin metal sheets, in order to manufacture pieces with a given 3D geometry, characterized in that said forming tool comprises an upper matrix comprising at least one pressurized gas injection nozzle, and a lower mold (conventionally, we shall consider the tool to be horizontal), whose upper side reproduces the 3D footprint of the piece to be formed, and comprising a means for heating its mass.

The sheet rests on the side supports of the footprint.

According to one specific embodiment, said mold is a female tool.

According to one embodiment of the invention, the metal is beryllium. This is the metal that both offers the greatest potential for tweeter or medium-frequency loudspeaker domes and presents the greatest forming difficulties.

According to another embodiment, said metal consists of aluminum and its alloys, or other materials known to the expert and adapted, based on the expert's knowledge, to the manufacture of a tweeter dome.

According to one specific embodiment, the starting thickness of sheets made of beryllium (or Al or aluminum alloys, or optionally beryllium alloys, in particular Be/Al alloys) is between 10 and 500 microns.

According to yet another specific embodiment, said thickness is between 20 and 100 microns.

According to yet another specific embodiment, said thickness is on the order of 25 to 50 microns.

The gas injected by the nozzle(s) is either air or nitrogen. Preferably nitrogen is to be used.

According to one specific embodiment, the pressure of said gas should be between 10 and 30 bars for a dome diameter of less than 50 mm.

According to yet another specific embodiment said pressure should be between 15 and 25 bars.

According to yet another specific embodiment said pressure shall be approximately 20 bars for a beryllium sheet with a thickness of 25 microns.

According to one variant, said pressure shall be 15 bars for an aluminum sheet with a thickness of 25 microns.

The mold is brought to a temperature on the order of 100 to 400° C. for sheets made of aluminum or magnesium, or their alloys, and on the order of 700 to 1000° C. for a sheet made of beryllium or its alloys, in its mass, for example by means of a heating element 20 placed underneath or around said mold.

According to a specific embodiment, said temperature is on the order of 900° C. for a pure beryllium sheet with a thickness of 25 microns.

The expert knows that in the case of alloys, the temperature will have to be lower than for pure metals; therefore, the expert shall adapt the above temperature ranges based on the alloys he/she wishes to use, and, if necessary, shall be guided by a few simple routine tests.

The forming tool is made of any material suitable for transmitting the process temperature and withstanding the applied pressure, and that does not react, under these temperature and pressure conditions, with beryllium. Among such materials, we shall cite in particular steels, optionally with a surface treatment.

EXAMPLES

1. By using the above process and tool, a tweeter dome 25 mm in diameter was formed in just two minutes with a beryllium sheet 25 microns thick, using N2 as the pressure-applying gas and applying to the sheet, through the mold, a temperature of 900° C.

2. By using the above process and tool, a tweeter dome 35 mm in diameter was formed in just three minutes with a sheet made of 60% beryllium and 40% Al, 30 microns thick, using N2 as the pressure-applying gas and applying to the sheet, through the mold, a temperature of 750° C.

3. By using the above process and tool, a dome for a medium-frequency loudspeaker, 120 mm in diameter, was formed in just five minutes and 30 seconds with a beryllium sheet 0.1 mm thick, using N2 as the pressure-applying gas and applying to the sheet, through the mold, a temperature of 900° C.

4. By using the above process and tool, a tweeter dome, 35 mm in diameter, was formed in just 15 seconds with a sheet made of an AlMg alloy (95% Al/5% Mg), 38 microns thick, using N2 as the pressure-applying gas and by applying to the sheet, through the mold, a temperature of 400° C.

The invention also relates to the domes for tweeters and medium-frequency loudspeakers thus manufactured, as well as the acoustic enclosures comprising at least one loudspeaker such as described above and/or at least one dome such as described above.

The invention also covers all the embodiments and all the applications that will be directly accessible to the expert upon reading this application, based on his own knowledge, and, optionally, upon carrying out simple routine tests.

The invention claimed is:

1. A tweeter loudspeaker for acoustic enclosure, the loudspeaker comprising:

a spool, and a dome that is a spherical membrane or diaphragm with direct radiation, wherein the dome has a front side that is concave in relation to the spool, and the spool is attached to the dome at mid-height or approximately at mid-height of the spherical membrane or diaphragm so as to achieve an optimal mechanical coupling capable of reproducing frequencies lower than 1 kHz with a high efficiency.

2. The loudspeaker according to claim 1, wherein the low resonance frequency is adjustable by using a mounted suspension with high compliance, that is to say, made of a highly flexible material such as foam rubber or soft joints made of rubber, or gluing that remains "soft" over time.

3. The loudspeaker according to claim 1, wherein the material of the dome is pure beryllium (Be).

4. The loudspeaker according to claim 3, wherein the diaphragm is made of pure Be and has a thickness from 25 to 100 microns.

5. The loudspeaker according to claim 4, wherein the diaphragm made of pure Be has a thickness of less than 30 microns for a typical tweeter dome 25 mm in diameter and 3 to 6 mm deep and a spool 15 to 20 mm in diameter.

6. The loudspeaker according to claim 4, wherein the diaphragm made of pure Be has a thickness equal to 25 microns.

7. The loudspeaker according to claim 3, wherein for a medium-frequency loudspeaker of 100 mm in diameter, the diaphragm made of pure Be has a thickness of no more than 500 microns for the dome.

8. The loudspeaker according to claim 1, wherein the material of the dome is selected from among Be alloys with at least 5% by weight of Be.

9. The loudspeaker according to claim 8, wherein the selected Be alloy material of the dome is a Be/Al alloy.

10. The loudspeaker according to claim 9, wherein Be/Al alloy is 20-80% Be by weight and 80-20% Al by weight.

11. The loudspeaker according to claim 10, wherein Be/Al alloy is 40-60% Be and 60-40% Al.

12. The loudspeaker according to claim 1, wherein the material of the dome is made of materials selected from among aluminum or aluminum alloys.

13. The loudspeaker according to claim 12, wherein said aluminum alloy is an Al/Be alloy.

14. The loudspeaker according to claim 1, wherein the material of the dome is selected from among magnesium and its alloys with aluminum.

15. The loudspeaker according to claim 14, wherein the alloy is Al 5056, which is an aluminum alloy containing approximately 5% magnesium.

16. The loudspeaker according to claim 1, wherein the shape of the dome is hemispherical or with a complex profile, oval, bulbous, or with canted sides.

17. The loudspeaker according to claim 1, wherein the loudspeaker comprises a "monobloc" dome.

18. The loudspeaker according to claim 1, wherein with a diaphragm made of pure Be, the high-frequency response is extended to over 40 kHz.

19. The loudspeaker according to claim 1, wherein the loudspeaker further comprises an emitter point source with direct radiation and low directivity, with a passband of over 5 octaves from 1 kHz to 40 kHz with a high efficiency of over 92 dB/1 W/1 m.

20. A dome for a loudspeaker for an acoustic enclosure, in particular for a tweeter or for a medium-frequency loudspeaker, wherein it is such as is described according to claim 1.

21. An acoustic enclosure, wherein it comprises at least one dome according to claim 20.

22. An acoustic enclosure, wherein it comprises at least one loudspeaker according to claim 1.

23. A diaphragm manufacturing process involving the forming of thin metal sheets made of metals or alloys described according to claim 1, for manufacturing tweeter or medium-frequency loudspeaker domes, wherein the sheet rests on the side supports of a footprint, said sheet is deformed by a gas pressure applied at room or near-room temperature to one of its sides, said pressure effect is then used to apply the second side of said deformed sheet onto a mold that reproduces the 3D geometry ("footprint") of the piece to be produced, and finally said mold is brought to a high temperature during the time necessary for forming said sheet without any physico-chemical degradation.

24. A sheet metal forming tool for manufacturing pieces with a given 3D geometry, for the implementation of the process according to claim 23, wherein it comprises an upper matrix consisting of at least one pressurized gas injection nozzle and a lower mold (by convention, the tool shall be considered as horizontal) whose upper side reproduces the 3D footprint of the piece to be formed and which has a means for heating its mass.

25. The process according to claim 23, wherein the starting thickness of the sheets made of beryllium (Be) or aluminum (Al) or aluminum alloys or beryllium alloys or Be/Al alloys is between 10 and 500 microns.

26. The process according to claim 25, wherein the starting thickness of the sheets is between 20 and 100 microns.

27. The process according to claim 26, wherein the starting thickness of the sheets is on the order of 25 to 50 microns.

28. The process according to claim 23, wherein the gas injected by the nozzle(s) is either air or nitrogen.

29. The process according to claim 23, wherein the pressure of said gas is between 10 and 30 bars for a dome diameter of less than 50 mm.

30. The process according to claim 29, wherein the pressure of said gas is between 15 and 25 bars for a dome diameter of less than 50 mm.

31. The process according to claim 30, wherein the pressure of said gas is approximately 20 bars for a beryllium sheet 25 microns thick and approximately 15 bars for an aluminum sheet 25 microns thick.

32. The process according to claim 23, wherein the mold is brought to a temperature on the order of 100 to 400° C. for sheets made of aluminum or magnesium or their alloys, on the order of 700 to 1000° C. for a sheet made of beryllium or its alloys, in its mass, for example by means of a heating element placed underneath or around said mold, said temperature being on the order of 900° C. for a pure beryllium sheet 25 microns thick.

33. A dome for a loudspeaker for an acoustic enclosure, in particular for a tweeter or for a medium-frequency loudspeaker wherein it is manufactured by using the process according to claim 23.

* * * * *